US008814589B2

(12) United States Patent
Chien

(10) Patent No.: US 8,814,589 B2
(45) Date of Patent: Aug. 26, 2014

(54) PLUG CONNECTOR

(75) Inventor: Yu-Chin Chien, New Taipei (TW)

(73) Assignee: Chant Sincere Co., Ltd., New Taipei (TW)

( * ) Notice: Subject to any disclaimer, the term of this patent is extended or adjusted under 35 U.S.C. 154(b) by 156 days.

(21) Appl. No.: 13/487,288

(22) Filed: Jun. 4, 2012

(65) Prior Publication Data

US 2013/0323962 A1 Dec. 5, 2013

(51) Int. Cl.
*H01R 4/24* (2006.01)

(52) U.S. Cl.
USPC ..... 439/393

(58) Field of Classification Search
USPC ..... 439/393–417
See application file for complete search history.

(56) References Cited

U.S. PATENT DOCUMENTS 6,287,149 B1 * 9/2001 Elkhatib et al. ..... 439/607.41
6,955,563 B1 * 10/2005 Croan ..... 439/578
7,249,979 B2 * 7/2007 Gerber et al. ..... 439/676
7,887,366 B2 * 2/2011 Chee et al. ..... 439/585
8,272,893 B2 * 9/2012 Burris et al. ..... 439/578
8,323,060 B2 * 12/2012 Purdy et al. ..... 439/792
8,337,229 B2 * 12/2012 Montena ..... 439/322
8,460,024 B2 * 6/2013 Damodharan et al. ..... 439/395
2005/0175404 A1 * 8/2005 Conway ..... 403/348
2006/0246780 A1 * 11/2006 Bert et al. ..... 439/608
2010/0048061 A1 * 2/2010 Helmig et al. ..... 439/620.23
2013/0164986 A1 * 6/2013 Staudigel et al. ..... 439/626

* cited by examiner

*Primary Examiner* — Briggitte R Hammond
(74) *Attorney, Agent, or Firm* — Bacon & Thomas, PLLC

(57) ABSTRACT

A plug connector includes an insulative body, a housing and a plurality of terminals, and electrically connects to an electrical cable in a manner of insulation-displacement. The insulative body defines a top piece having an external thread of a first screw portion in one end, and defines a plurality of inserting grooves disposed with the terminals. The housing defines an interior space communicating with the inserting grooves, and defines an inner thread of a second screw portion in one end. The interior space accommodates a holding block remaining an electrical conductor of the electrical cable bent out. The housing connects the insulative body with the inner thread to the external thread.

10 Claims, 7 Drawing Sheets

PLUG CONNECTOR

BACKGROUND OF THE INVENTION

1. Field of the Invention

The present invention relates generally to plug connector, and more specifically, to a plug connector adapted for use on an electrical cable of data transmission, thereto complied with IEC 61076-2-101.

2. Description of the Related Art

It is generally known to a type of electrical connector that a couple of transmission wires connect each other through contact terminals therein, of which the electrical connector provides with lock rings and is locking by means of engaging with a pair of screws, see for example, U.S. patent application Ser. No. 2012/0015539 A1. Particularly, a round-type connector called "M12 connector" having 4 pins, 5 pins, and 8 pins, is typically complied with the international standard to be specific in the determination of IEC 61076-2-101.

According to identified locking means used to connect between connectors, such point in favor is equivalently adopted to fix, as unlikely extractable, the connector parts wherein it screws up an inner thread portion configured on surface of one connector part to an outer thread portion configured on surface of the counterpart.

However, conventional techniques encounter with a few drawbacks, such as while contact terminals of the connector are connected to signal wires of the cable, contact terminals are to be soldering-mounted to the wires through the interior space in a housing of the connector, thereto conducting signals. In this way, to achieve that the connector which assembles with wire-connected contact terminals, is then sealing the housing to accomplish the final process, it is necessary prior to ensure that the molten solder cools rapidly and becomes completely solid covered on both the terminals and wires, using a method of cooling. If so, assembly process should be too much complex steps, operation costs increase more, and motion of improvement will be frustrated, that ultimately becomes an ill condition.

In addition, in order to ensure the efficiency in wiring, a connector technology is known as insulation-displacement connector (IDC), for example, U.S. Pat. No. 3,820,055 is disclosed. The characteristic in which refers to a punch work on terminals of the connector and signal wires of the cables, a piece of insulation displacement (hereafter, IDC piece) is to stand up perpendicular to longitudinal direction of the connector. Therefore, an upper space is required during piercing wires with IDC piece. However, the connector becomes undesirably longer, which is a worse condition for downsizing.

SUMMARY OF THE INVENTION

Therefore, the present invention is directed to an improved plug connector in which a round-type connector having 4 pins is typically following with the determination of international standard, as like IEC 61076-2-101.

A plug connector includes an insulative body, a housing and a plurality of terminals, and electrically connects to an electrical cable in a manner of insulation-displacement. The insulative body defines a top piece having an external thread of a first screw portion in one end, and defines a plurality of inserting grooves disposed the terminals. The housing defines an interior space communicating with the inserting grooves, and defines an inner thread of a second screw portion in one end. The interior space accommodates a holding block remaining an electrical conductor of the electrical cable bent out. The housing connects the insulating body with the inner thread to the external thread.

Moreover, the holding block includes a fitting post connecting to a fitting hole which closed to inserting grooves, in the top surface of the holding block opposed to the bottom side of said insulative body. And, the housing configures a bottom portion being able to force the body of the holding block ascending in the interior space.

DETAILED DESCRIPTION OF THE EMBODIMENT(S)

The present invention relates to an electrical connector, especially to a plug connector with parts fixed each other, providing a solution to screw up an inner thread portion configured on surface of one part to an outer thread portion configured on the counterpart.

Figure 1:
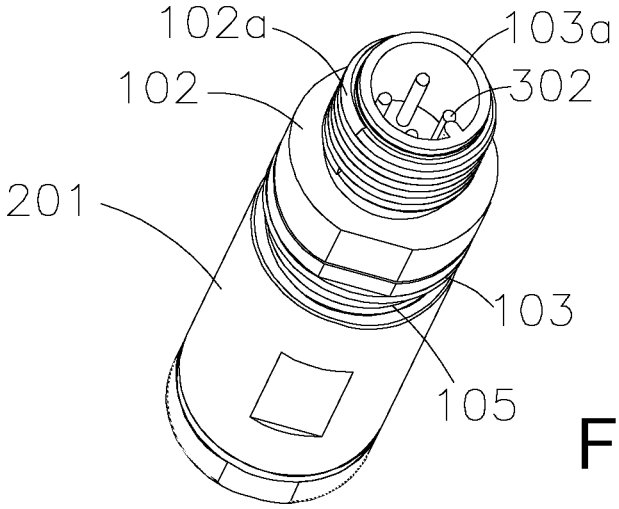
FIG. 1 is a perspective view of the plug connector formed in accordance with an embodiment of the invention.
Figure 2:
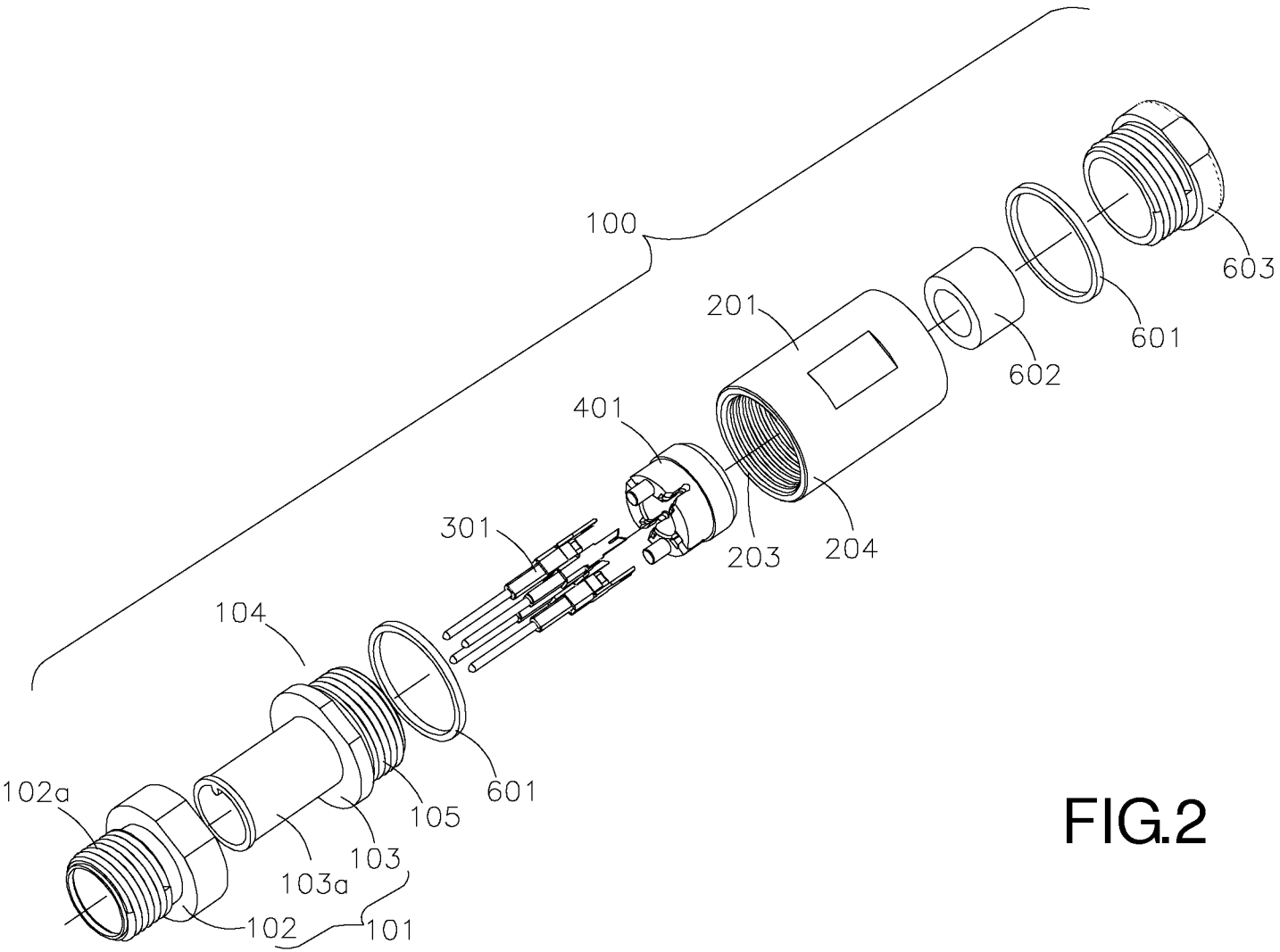
FIG. 2 is an exploded perspective view of the plug connector shown in FIG. 1.
Figure 3:
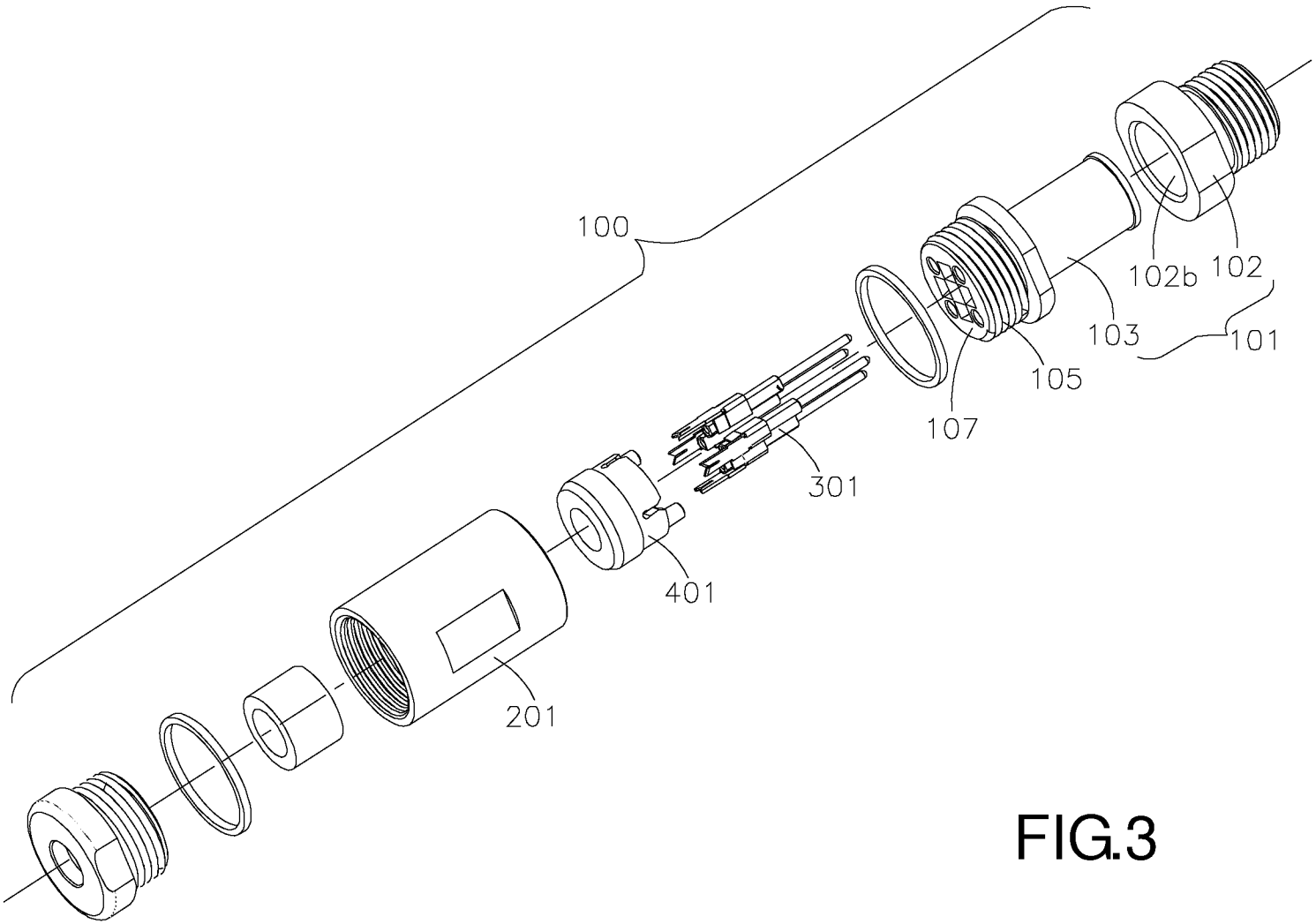
FIG. 3 is a further exploded perspective view of the plug connector shown in FIG. 1.
Figure 8:
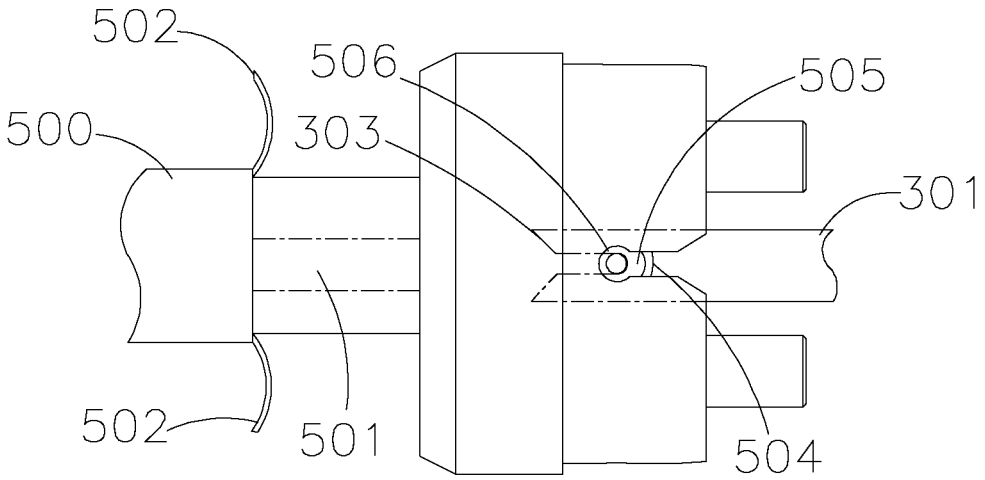
FIG. 8 is a side view of the holding block shown in FIG. 7, wherein the contact portion of the terminal is connected to the electrical conductor in a manner according to the invention.

As shown in FIGS. 1-3, a plug connector 100 comprises: a top piece 101, a housing 201, a plurality of terminals 301, a holding block 401 and an electrical cable 500 (FIG. 8).

The coupling unit (not shown in the drawing) consists of two circular plug type connectors connecting to each other by means of screwing up the treaded parts. One of connector loaded with male contacts, hereafter, as plug connector 100. Correspondingly, the other connector loaded with female contacts, hereafter, as socket connector (not shown in the drawing).

The plug connector 100 in the present invention is a M12 connector complied with the international standard to be specific in the determination of IEC 61076-2-101. An insulative body 103 configures a top piece 101 with a sleeve section 102 of which the round-type plug connector 100 is so connected to a socket connector designed accordingly.

The circular top piece 101 is connected to a housing 201 having a circular appearance equivalently. Through back side of such housing 201, an electrical cable 500 passes to inside 203 of the housing 201 (in relation to FIG. 8).

The sleeve section 102 configuring a part of the top piece 101 is provided with a threaded sleeve 102*a* in single part, or in separated portions. The one end of sleeve section 102, against the other end having the thread 102*a*, configures a circumferential hollow portion 102*b* to join a coupling portion 103*a* at one end of the insulative body 103. The insulative body 103 is able to be pushed into the sleeve section 102 in the axial direction (longitudinal axis).

An external thread 105 is provided in a first screw portion 104 to engage an inner thread 205 (FIG. 11) of a second screw portion 204 by means of screwing up the treads 105, 205. The second screw portion 204 is provided with the housing 201, and connects to the insulative body 103.

Figure 9:
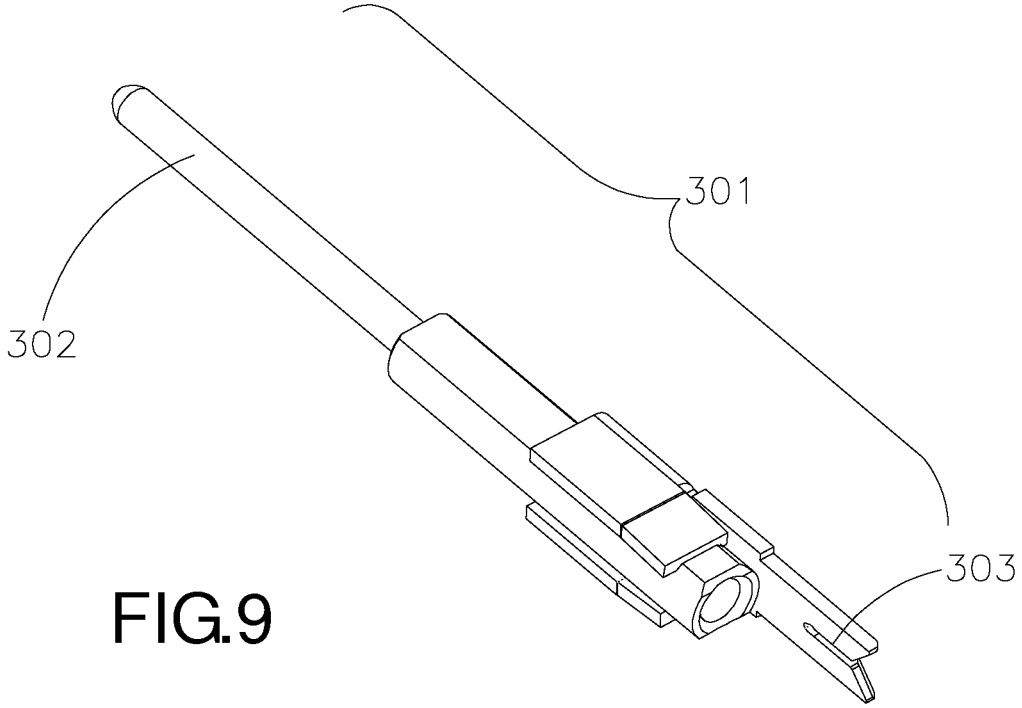
FIG. 9 is a perspective view of the terminal used in the plug connector shown in FIG. 2.
Figure 10:
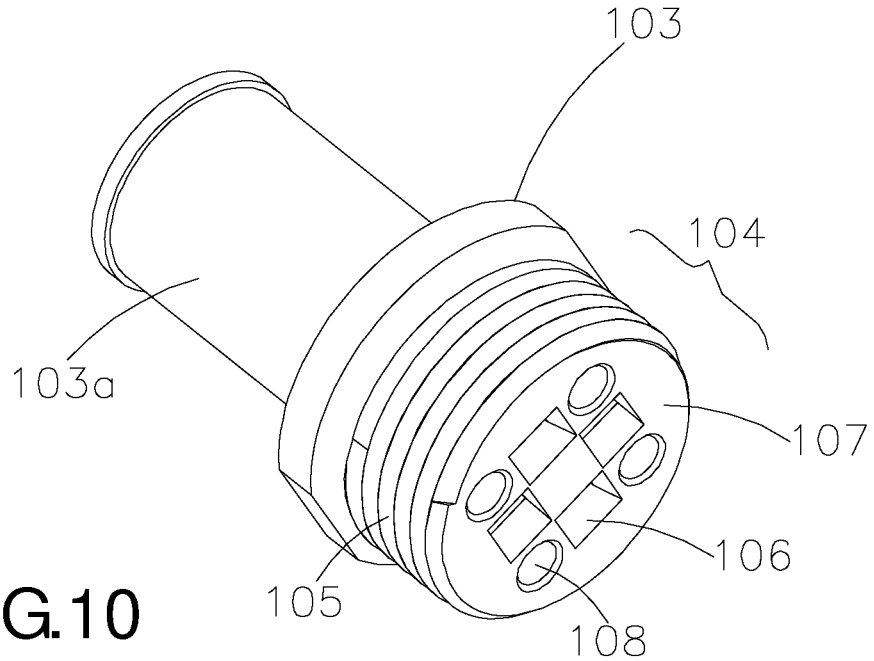
FIG. 10 is a perspective view of the insulative body used in the plug connector shown in FIG. 2.

The housing 201 defines an interior space 202 (FIG. 11) communicating with a plurality of inserting grooves 106 (FIG. 10) which is forming at bottom side 107 of the insulating body 103. The connecting contacts 302 (FIG. 9) are configuring at a plurality of terminals 301 fixed in the inserting grooves 106, and are disposed in the circular coupling portion 103*a* joined to the circumferential hollow portion 102*b*, which is the connecting area used to contact female contacts of the socket connector.

Figure 4:
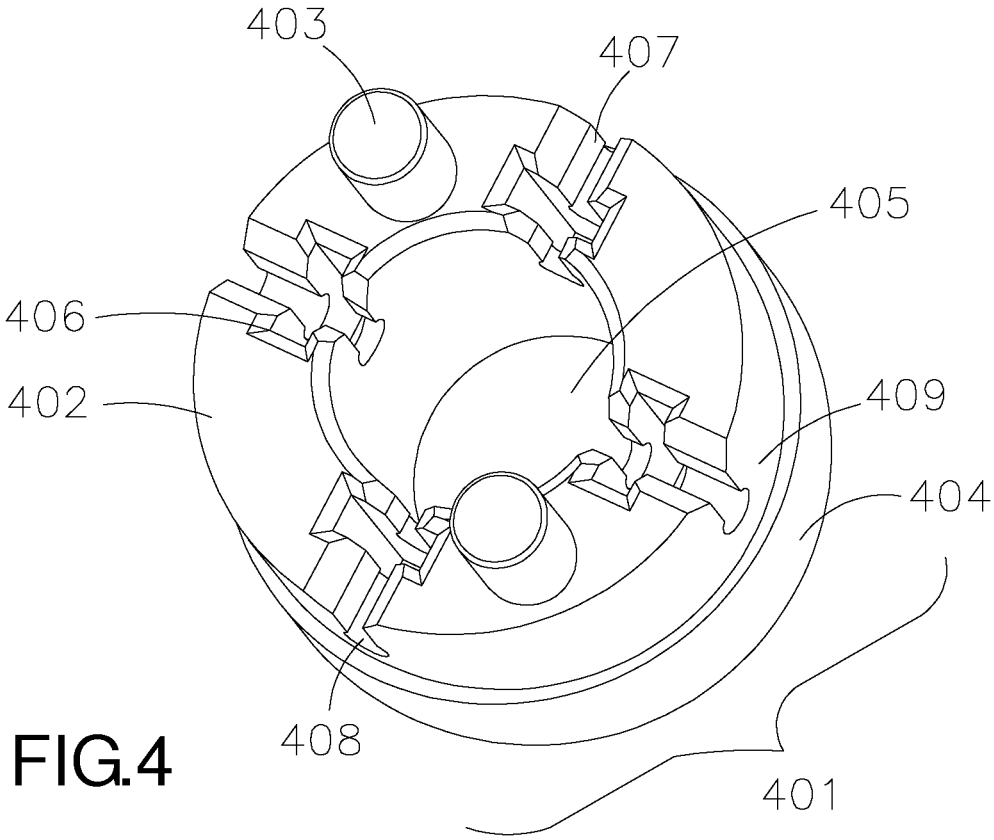
FIG. 4 is a perspective view of the holding block used in the plug connector shown in FIG. 2.
Figure 5:
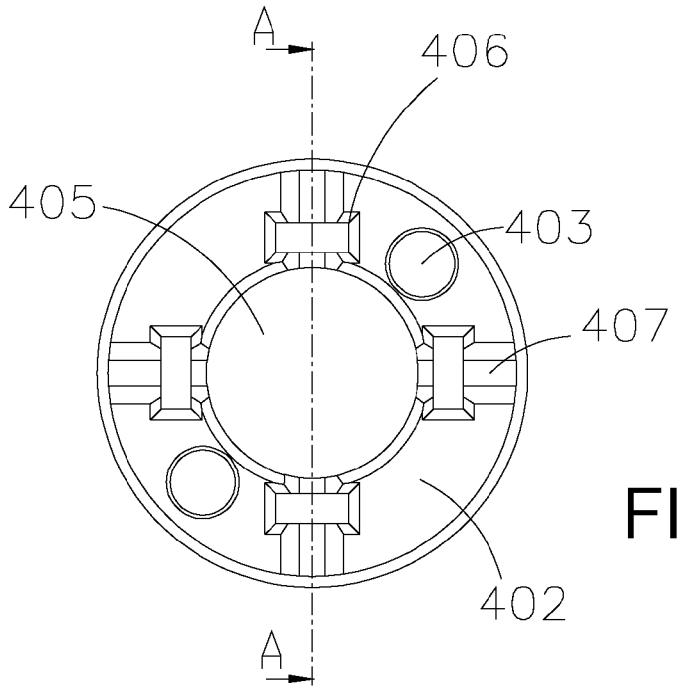
FIG. 5 is a top view of the holding block shown in FIG. 4.
Figure 6:
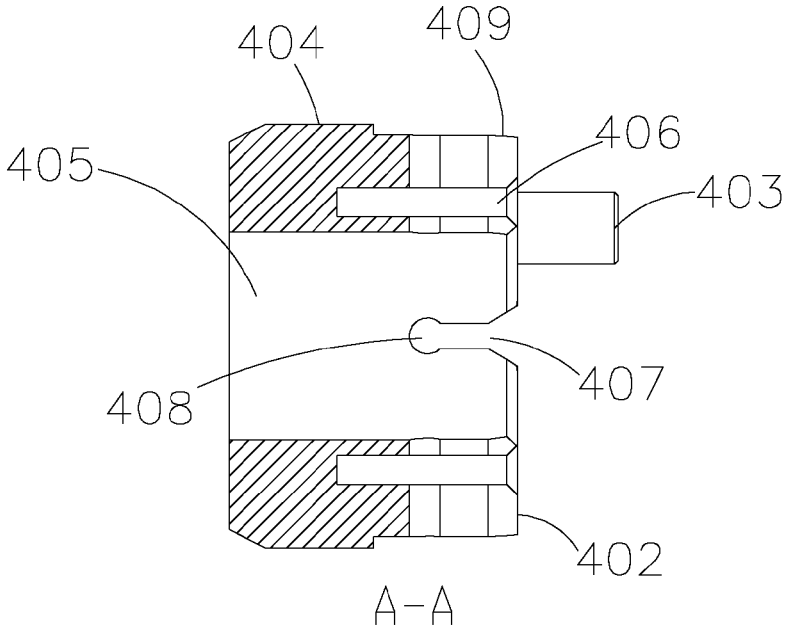
FIG. 6 is a cross-section view of the holding block shown in FIG. 4 taken along line A-A shown in FIG. 5.
Figure 7:
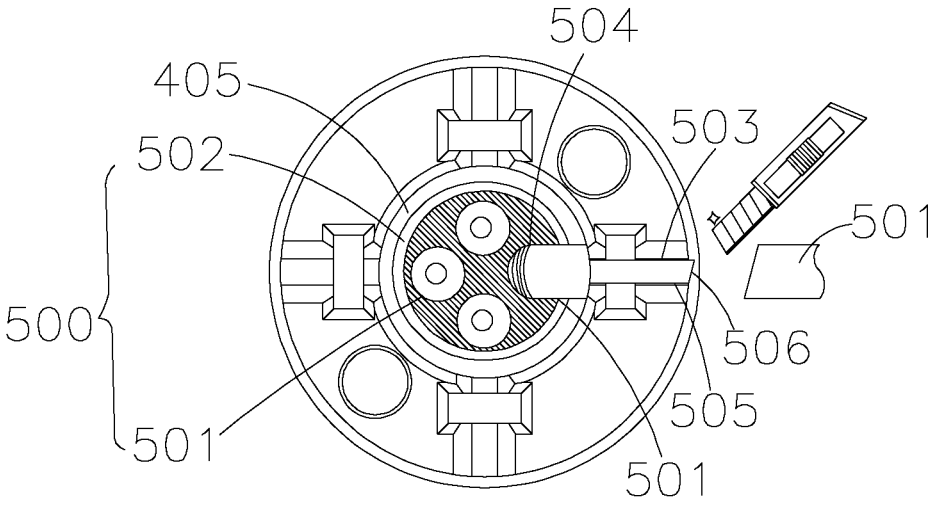
FIG. 7 is a top view of the holding block used in the plug connector shown in FIG. 2, wherein the electrical cable enters into the holding block and one of four electrical conductors is fixed in the groove.

The holding block 401 is to retain the electrical cable 500 by means of fixing an electrical conductor 501 (FIG. 8) onto a single insulative part. The electrical cable 500 passed to inside 203 of the housing 201 and fixed on the holding block 401, rests to an interior space 202 (FIG. 11) predetermined in the inside 203 of the housing 201 thereof. The holding block 401 is so configured, wherein a body portion 404 forming the bottom and the body of the holding block 401 is provided with sides 409 surrounding to the top surface 402 (shown in FIGS. 4-6).

Moreover, as shown in FIGS. 4-8, the electrical cable 500 consisting of electrical conductors 501 and jacket 502 contains the end sections 503. The holding block 401 being accommodating in the interior space 202 (FIG. 11) configures four guiding grooves 407 that is radially crossing above of a cable entrance 405, and four insulation-displacement grooves 406 (hereafter, IDC grooves). The holding block 401 is provided with guiding grooves 407 and retaining grooves 408 used to attach and hold the electrical conductors 501 of the electrical cable 500 wherein the retaining groove 408 is formed through guiding groove 407 from the top surface 402 as an extending-rounded void of on the side 409.

In addition, the IDC grooves 406 is receiving a contact portion 303 (FIG. 9) of the terminal 301, which is formed with a deeper depth than the guiding groove 407 so as to be crossed to the guiding groove 407, wherein the IDC grooves 406 received a blade configured in the contact portion 303. By peeling off the jacket 502 at end of the electrical cable 500, a displaced section predetermined to the electrical conductors 501 is arranged, in which four electrical conductors 501 are exposed appropriate lengths thereof.

The electrical conductors 501 are inserted into a cable entrance 405 of the holding block 401 and then the end sections 503 are pressed into the guiding grooves 407 and retaining groove 408 that are radial and directed outwardly to the jacket 502 as well. Therefore, the bent portion 504 is so configured and be able to connect to the blade configured in the contact portion 303 in a manner of insulation-displacement. That is so the holding block 401 remaining the end sections 503 bent out. The bent portion 504 retained in the retaining groove 408, forms a cutout 506 by cutting out the unwanted end 505 protruded out of the side 409 of the holding block 401.

Figure 11:
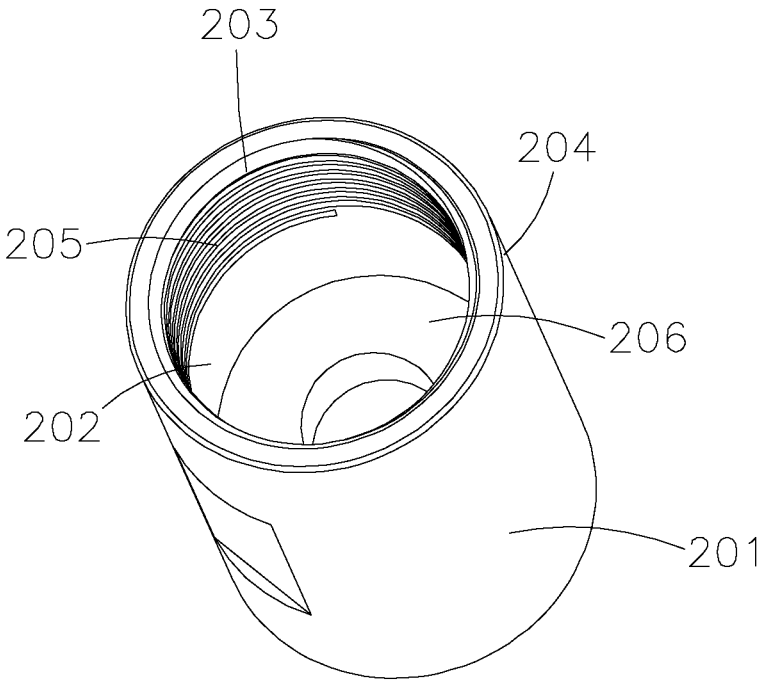
FIG. 11 is a perspective view of the housing used in the plug connector shown in FIG. 2.

The holding block 401 accommodated in the interior space 202 (FIG. 11) of the housing 201 includes fitting posts 403 connecting to fitting holes 108 (FIG. 10) closed to inserting grooves 106, in the top surface 402 of the holding block 401, which is opposed to the bottom side 107 of the insulative body 103; and the housing 201 accommodated the holding block 401, which provided the second screw portion 204 includes a bottom portion 206 (FIG. 11) that is able to force the body portion 404 of the holding block 401 ascending in the interior space 202 (FIG. 11). In this way, while the first screw portion 104 is screwing up with the second screw portion 204, in other words, when the insulative body 103 is engaging to the housing 201, the bottom portion 206 of the housing 201 compresses the interior space 202 (FIG. 11) by reducing space in the inside 203, and slowly pushes up the body portion 404 of the holding block 401.

In the case of which request to maintain the waterproof characteristics, the plug connector 100 in the present invention is must to be in close contact with each part, as like to secure tight engagement of screw portions 104, 204, or to prevent the detachment of the connectors. For doing that, some correspond ways are directed to maintain waterproof characteristics and gain waterproof effects, as if retaining rings 601 are provided with the parts to closely contact each other, or a rubber 602 sealed by a bottom lid 603 are provided with the housing 201 as a housing assembly.

The plug connector 100 in accordance with an embodiment of the present invention, which includes a holding block remaining one end section of an electrical conductor of an electrical cable bent out, provides a contact portion of terminal with above-mentioned bent portion to connect each other in a manner of insulation-displacement in which a direction opposed to the connector axis; the plug connector 100 is provided to fit an insulative body with body of a holding block by means of screwing up the treaded parts, wherein a top piece is connected to a housing that insulation-displacement connection is happened in a short space against the length of the axial direction of the connector. Compared to the technology of conventional connector, an upper space is not required during piercing wires with IDC piece in the present invention so that the work process is able to be less, the IDC processing is improved to be more easier, and the possibility to downsize is also increased.

While the invention has been described in terms of various specific embodiments, those skilled in the art will recognize that the invention can be practiced with modification within the spirit and scope of the claims.

What is claimed is:

1. A plug connector, comprising:

an insulative body defining a top piece with a sleeve section wherein a first screw portion configuring an external thread in one end; and a housing defining an interior space communicating with inserting grooves forming at bottom side of said insulative body wherein a second screw portion configuring an inner thread in one end; and a holding block being accommodated in said interior space, wherein at least one end section of an electrical conductor of an electrical cable is bent outward and a cutout is formed at an end of said bent section; and a plurality of terminals being disposed in said inserting grooves, and having a blade contact section which connects to said bent section in a manner of insulation-displacement.

2. The plug connector of claim 1, wherein said holding block having a fitting post connecting to a fitting hole closed to said inserting grooves, in the top surface of said holding block opposed to the bottom side of said insulative body.

3. The plug connector of claim 1, wherein said housing having a bottom portion being able to force a body portion of said holding block ascending in said interior space.

4. The plug connector of claim 1, wherein said holding block configures four insulation-displacement grooves and four guiding grooves that are radially crossing above a cable entrance.

5. The plug connector of claim 4, wherein said holding block is provided with guiding grooves and retaining grooves used to attach and hold the electrical conductors of the electrical cable wherein each retaining groove is formed through the guiding groove from the top surface as a continuous rounded void on the side of said holding block.

6. The plug connector of claim 5, wherein said insulation-displacement groove is receiving a contact portion of the terminal and is located in the cross direction at the guiding groove wherein the insulation-displacement groove receives a blade configured at the contact portion.

7. The plug connector of claim 1, wherein the one end of said sleeve section, against the other end having threads, configures a circumferential hollow portion to join a coupling portion at the insulative body.

8. The plug connector of claim 7, wherein the connecting contacts are configuring at a plurality of terminals fixed in said inserting grooves, and are disposed in said circular coupling portion joined to said circumferential hollow portion, which is the connecting area used to contact female contacts of a socket connector.

9. The plug connector of claim 3, wherein said holding block is so configured wherein said body portion forming the bottom and the body of said holding block is provided with sides of said holding block surrounding to said top surface.

10. The plug connector of claim 1, wherein said electrical cable consisting of electrical conductors and a jacket contains said at least one end sections, and a displaced section predetermined to said electrical conductors is arranged by peeling off said jacket at end of the electrical cable, in which said electrical conductor exposes in appropriate lengths for employing insulation-displacement.

* * * * *